US008742932B2

(12) United States Patent
Casares

(10) Patent No.: US 8,742,932 B2
(45) Date of Patent: Jun. 3, 2014

(54) HAND WASH AND SANITATION DEVICE

(76) Inventor: Carlos Maxwell Casares, Ciudad Autonoma de Buenos Aires (AR)

( * ) Notice: Subject to any disclaimer, the term of this patent is extended or adjusted under 35 U.S.C. 154(b) by 269 days.

(21) Appl. No.: 13/154,896

(22) Filed: Jun. 7, 2011

(65) Prior Publication Data

US 2011/0297696 A1 Dec. 8, 2011

Related U.S. Application Data

(60) Provisional application No. 61/352,011, filed on Jun. 7, 2010.

(51) Int. Cl.
*G08B 23/00* (2006.01)

(52) U.S. Cl.
USPC ..... 340/573.1; 340/5.2; 340/5.83; 222/52

(58) Field of Classification Search
USPC ..... 340/572.1, 573.1, 539.11, 5.2, 5.83; 222/52
See application file for complete search history.

(56) References Cited

U.S. PATENT DOCUMENTS

| | | | | |
|---|---|---|---|---|
| 5,429,272 | A | 7/1995 | Luigi | |
| 6,227,823 | B1 * | 5/2001 | Paul et al. | 417/440 |
| 6,706,243 | B1 | 3/2004 | Sias et al. | |
| 2003/0047441 | A1 | 3/2003 | Hensley | |
| 2007/0222554 | A1 * | 9/2007 | Hart | 340/5.6 |
| 2008/0100441 | A1 * | 5/2008 | Prodanovich et al. | 340/572.1 |
| 2009/0051545 | A1 * | 2/2009 | Koblasz | 340/573.1 |
| 2009/0091458 | A1 * | 4/2009 | Deutsch | 340/573.1 |
| 2009/0219131 | A1 * | 9/2009 | Barnett et al. | 340/5.2 |
| 2009/0224907 | A1 * | 9/2009 | Sinha et al. | 340/539.11 |
| 2009/0295539 | A1 * | 12/2009 | Mahmoodi et al. | 340/5.83 |
| 2009/0299787 | A1 * | 12/2009 | Barnhill | 705/7 |
| 2010/0097224 | A1 * | 4/2010 | Prodanovich et al. | 340/572.1 |
| 2010/0164728 | A1 * | 7/2010 | Plost | 340/573.1 |
| 2010/0230435 | A1 * | 9/2010 | Wegelin | 222/52 |
| 2010/0265059 | A1 * | 10/2010 | Melker et al. | 340/539.11 |
| 2010/0284867 | A1 * | 11/2010 | Konesky | 422/186.06 |
| 2011/0227740 | A1 * | 9/2011 | Wohltjen | 340/573.1 |

* cited by examiner

*Primary Examiner* — Hoi Lau
(74) *Attorney, Agent, or Firm* — Evelyn A. Defillo; Defillo & Associates, Inc.

(57) ABSTRACT

A hand wash and sanitation device that controls the hygiene of the personnel while performing their work related functions in areas where complete asepsis is required. The hand wash and sanitation device that controls the use of the device by each one of the workers by using biometrics parameters and keeps records of the use of the device by each one of the workers during the preset schedule. The hand wash and sanitation device that detects if the personnel had properly sanitized their hands during a preset schedule and then takes the necessary steps to ensure the proper sanitization. The hand wash and sanitation device includes a hollow housing enclosing a biometric scanner connected to the housing, the biometric scanner reads a biometric parameter of a user, a screen located on the housing and connected to the biometric device, a liquid dispenser operatively connected to the biometric scanner, wherein the liquid dispenser dispenses a predetermined amount of an antiseptic formulation, a computer device including a software program, and the computer device is connected to the liquid dispenser and to the biometric dispenser.

12 Claims, 8 Drawing Sheets

HAND WASH AND SANITATION DEVICE

REFERENCE RELATED APPLICATIONS

This application is a non-provisional application based on U.S. Provisional Application No. 61/352,011 filed on Jun. 7, 2010, the content of which is incorporated by reference in this application.

FIELD OF THE INVENTION

The present invention relates to an electro-mechanical and computerized hand wash and sanitation device. More specifically, the present invention relates to a hand wash and sanitation device with full reliability hand disinfection in places and activities where conditions of asepsis are recommended, required, or mandatory.

BACKGROUND OF THE INVENTION

Food transmitted diseases (FTD) are produced by the ingestion of food and beverages contaminated with pathogen microorganisms that affect the health of the consumer. The most common symptoms are diarrhea and vomiting. In addition, other problems could appear such as septic shock, hepatitis, headaches, or double vision or even death.

The major infections are produced by bacteria, virus, and parasites. Until now more than 250 FTDs have been discovered. The most common FTD bacteria belongs to the species of *Campylobacter* and *Salmonella*. *Escherichia Coli* (*E. Coli*) being the most common FTD bacteria.

If we expand our scope to cover the full spectrum of sanitation technology it can be seen that FTD constitutes an important public health issue due to the rapid spread of disease, the new ways of transmission of the disease, the increase of new viruses and highly aggressive germs on vulnerable groups, but so does a defective hand hygiene in transmitting a growing number of intra-hospital infections and spreading contamination in the pharmaceutical industry as well.

The Worldwide Health Organization has reported that the 70% of those people and professionals involved in food handling as well as operating tasks of different nature at important health care institutions and laboratories and who are required to have strict hand hygiene, do not wash their hands.

FTD is a direct indicator of the hygienic and sanitary quality of the food handling process, and sanitary control in health care institutions as well as specific manufacturing industries is also the main cause of unreliable sanitary controls. Contamination by FTD occurs mostly because of poor hygienic practices by the food handlers or medical personnel. Food handlers and medical personnel are required by law to wash their hands constantly. Unfortunately, these important personnel do not wash their hands, or they wash them improperly, causing serious contamination problems that result in dangerous results.

There are not currently fully reliable devices or methods that will allow the Sanitary Control Department to control through a state-of-the-art computerized and or mechanically driven technology the hygiene of the personnel while performing their delicate work related functions.

As can be seen, there is a need for a device that manages and controls the hygiene of the personnel during the work day in order to prevent contamination disease spread.

SUMMARY OF THE INVENTION

It is an objective of the present invention to provide a totally reliable device for controlling the hygiene of personnel working in positions that require total disinfection of their hands to protect the health of third parties.

It is another objective of the present invention to provide a device for controlling the disinfection of hands of assigned personnel in facilities where it requires a strict maintenance of conditions of total asepsis such as surgical rooms and other asepsis related areas of the most varied nature.

The hand wash and sanitation device includes a hollow housing enclosing a biometric scanner connected to the housing, the biometric scanner reads a biometric parameter of a user who has previously been registered and identified, a screen located on the housing and connected to the biometric device, a liquid dispenser operatively connected to the biometric scanner, wherein the liquid dispenser dispenses a predetermined amount of an antiseptic formulation, a computer device including a software program specifically designed that commands the whole system, is connected to the liquid dispenser and to the biometric identifier.

The hand wash and sanitation device according to the present invention keeps records name, date and time of the use of the device by each one of the workers during the preset schedule. In addition, the hand wash and sanitation device WILL detect if the personnel has properly sanitized their hands according to the preset schedule to ensure the strict compliance with legal regulations and procedures.

The hand wash and sanitation device controls the schedule of employees, detail of worked hours, and a control of visits to the bathroom. All of these functions are properly recorded in daily, weekly or monthly reports. Every day, each worker may be informed of any violation of the preset schedule.

The foregoing has outlined some of the more pertinent objectives of the present invention. These objectives should be construed to be merely illustrative of some of the more pertinent features and applications of the invention. Many other beneficial results can be obtained by applying the disclosed invention in a different manner or modifying the invention within the scope of the disclosure.

Continuous updates of the original machine will take place as a standard procedure, and they will be added to the present patent of invention.

BRIEF DESCRIPTION OF DRAWINGS

For a fuller understanding of the nature and objectives of the invention, reference should be made to the following detailed description taken in connection with the accompanying drawings in which.

DETAILED DESCRIPTION OF THE INVENTION

Figure 1:
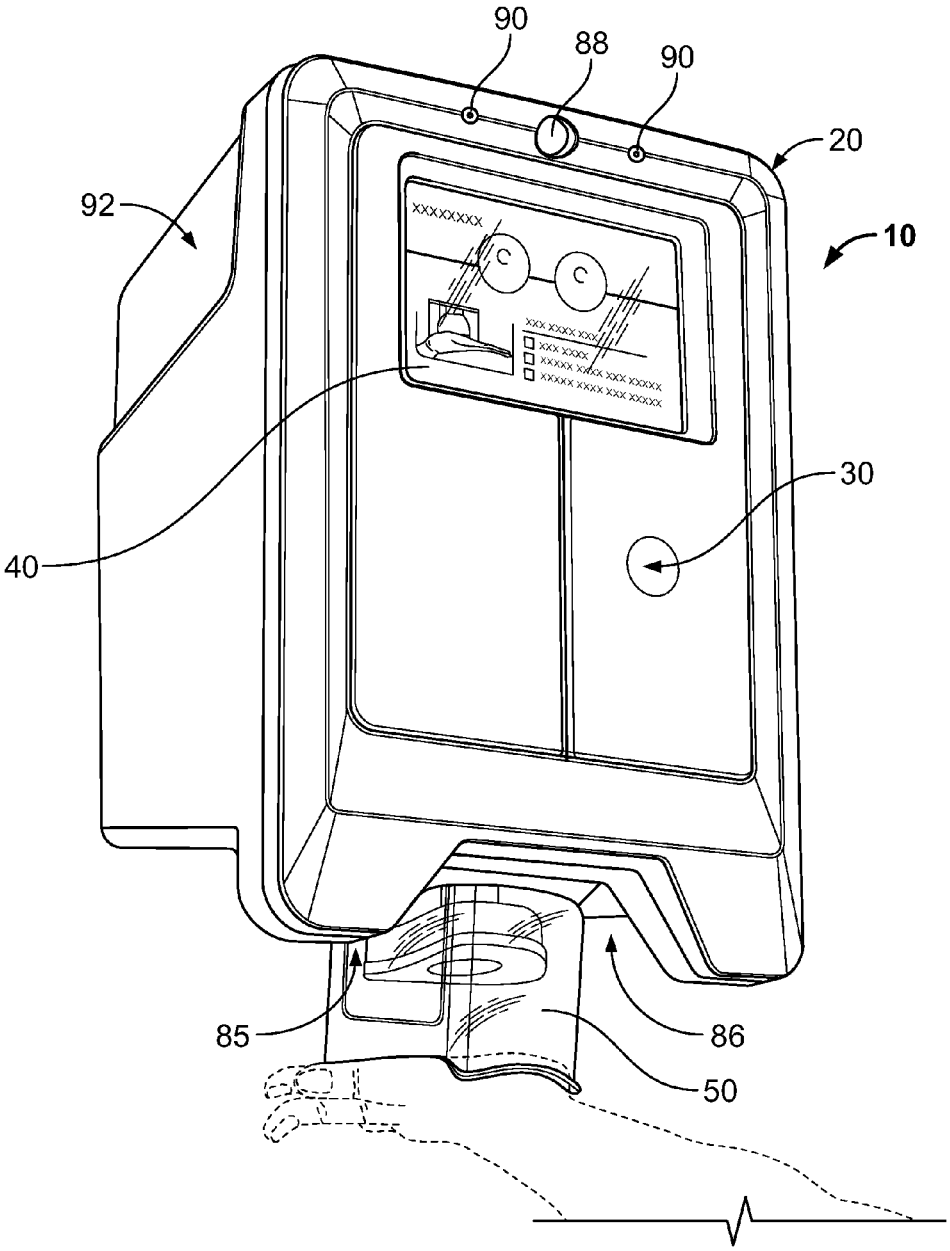
FIG. 1 illustrates a perspective front view of a hand wash and sanitation device according to an exemplary embodiment of the present invention.
Figure 2:
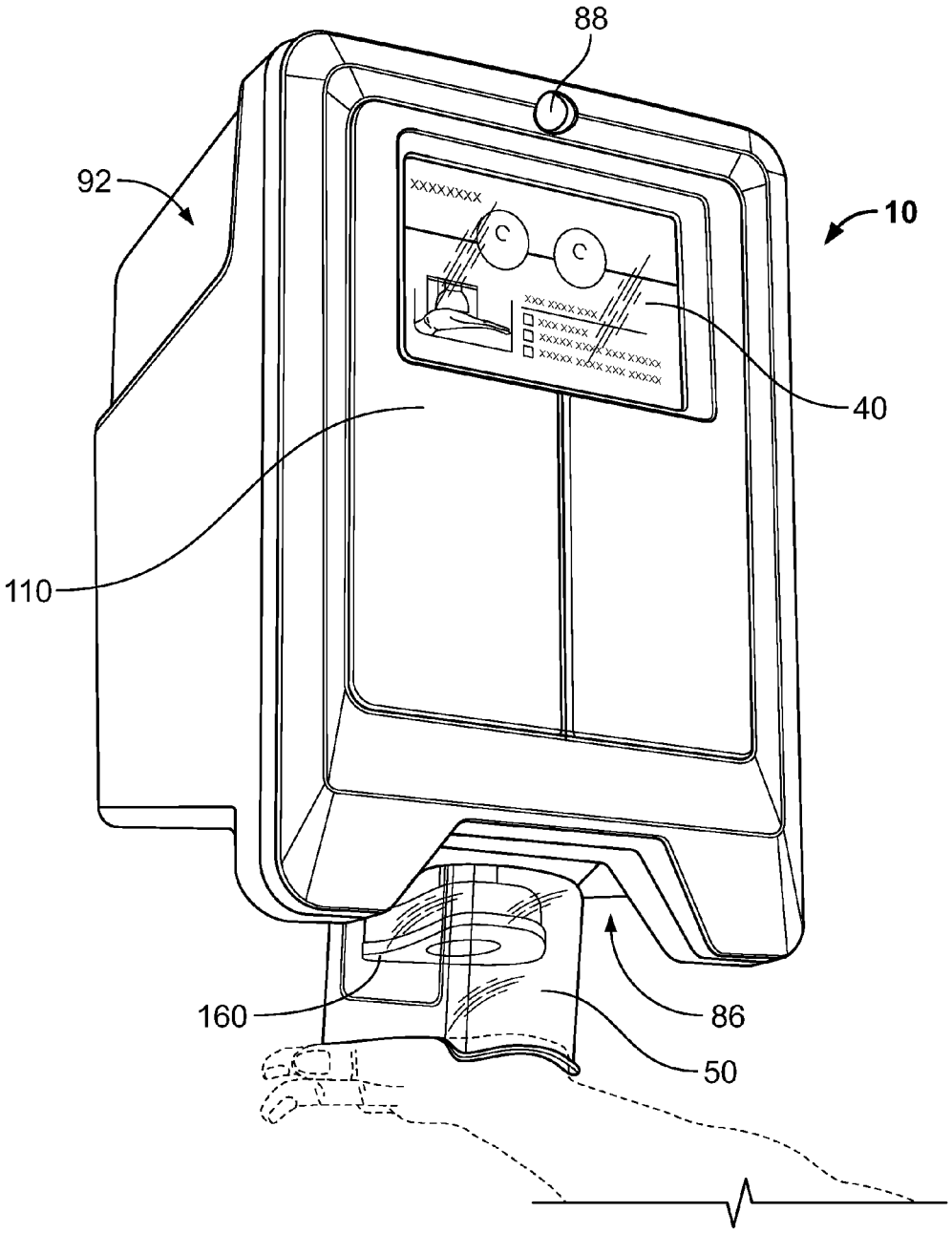
FIG. 2 illustrates a perspective front view of a hand wash and sanitation device of FIG. 1 showing additional elements of the device.
Figure 3:
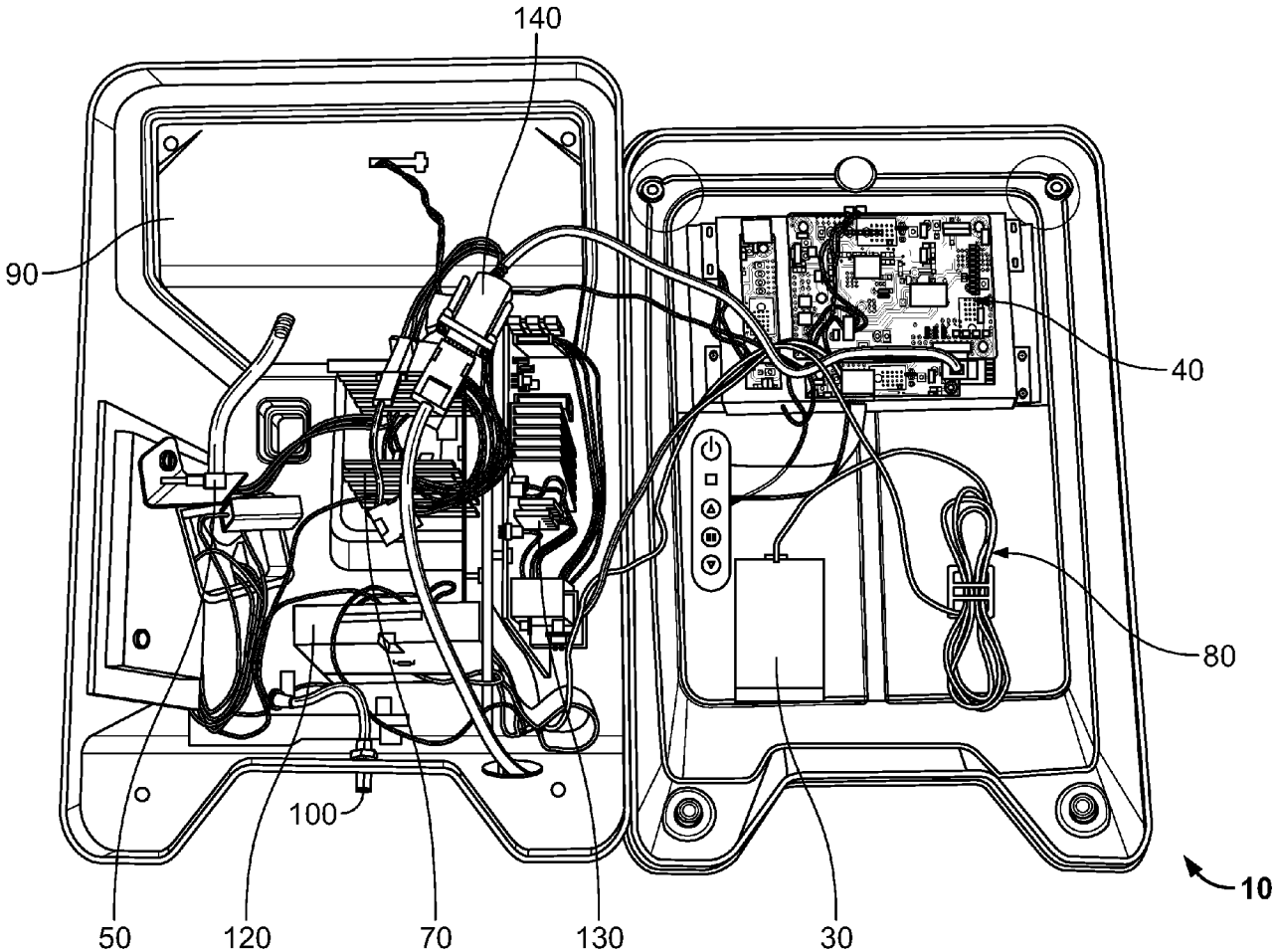
FIG. 3 illustrates an inside view of the hand wash and sanitation device of FIG. 1.
Figure 4A:
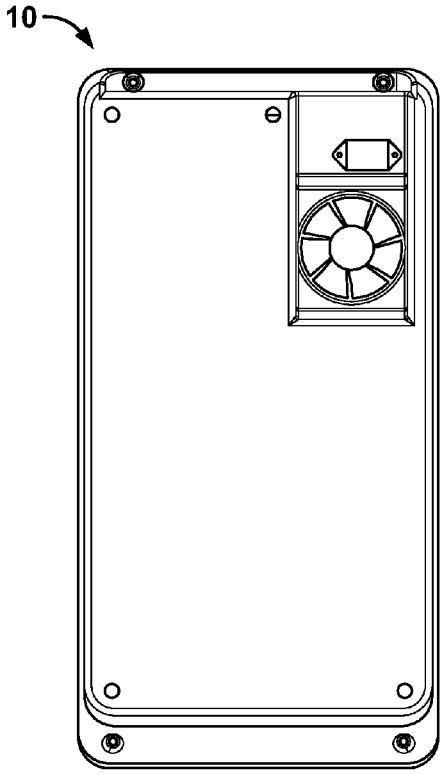
FIGS. 4*a-d* illustrate different views of the hand wash and sanitation device of FIG. 1 showing measurements of the device according to an exemplary embodiment of the present invention.
Figure 4B:
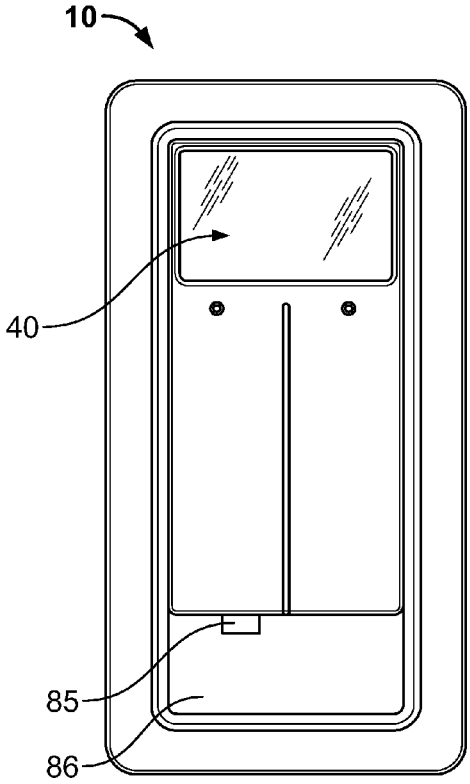
Figure 4C:
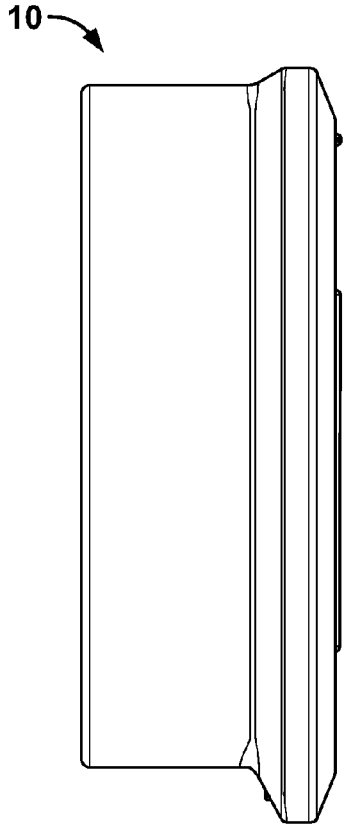
Figure 4D:
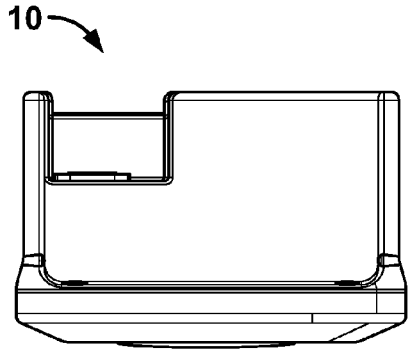
Figure 5:
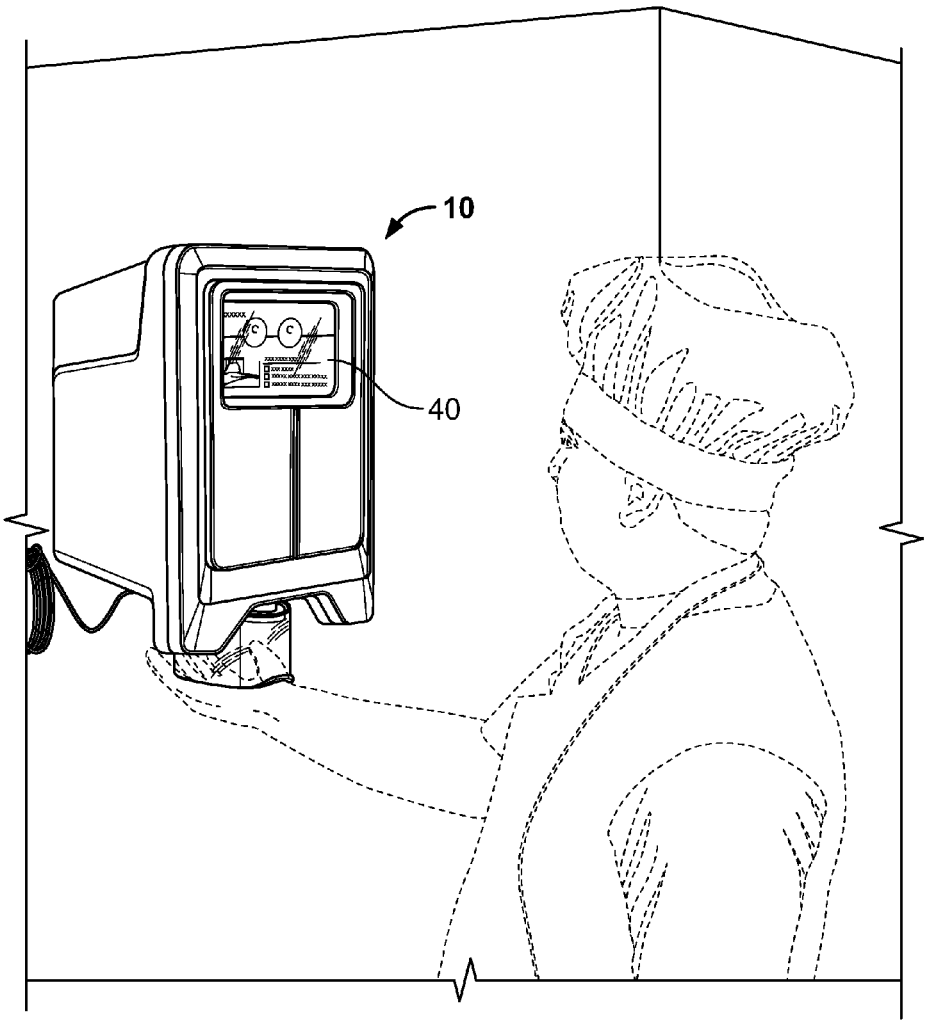
FIG. 5 illustrates a front view of the hand wash and sanitation device of FIG. 1 showing the device in use.
Figure 6:
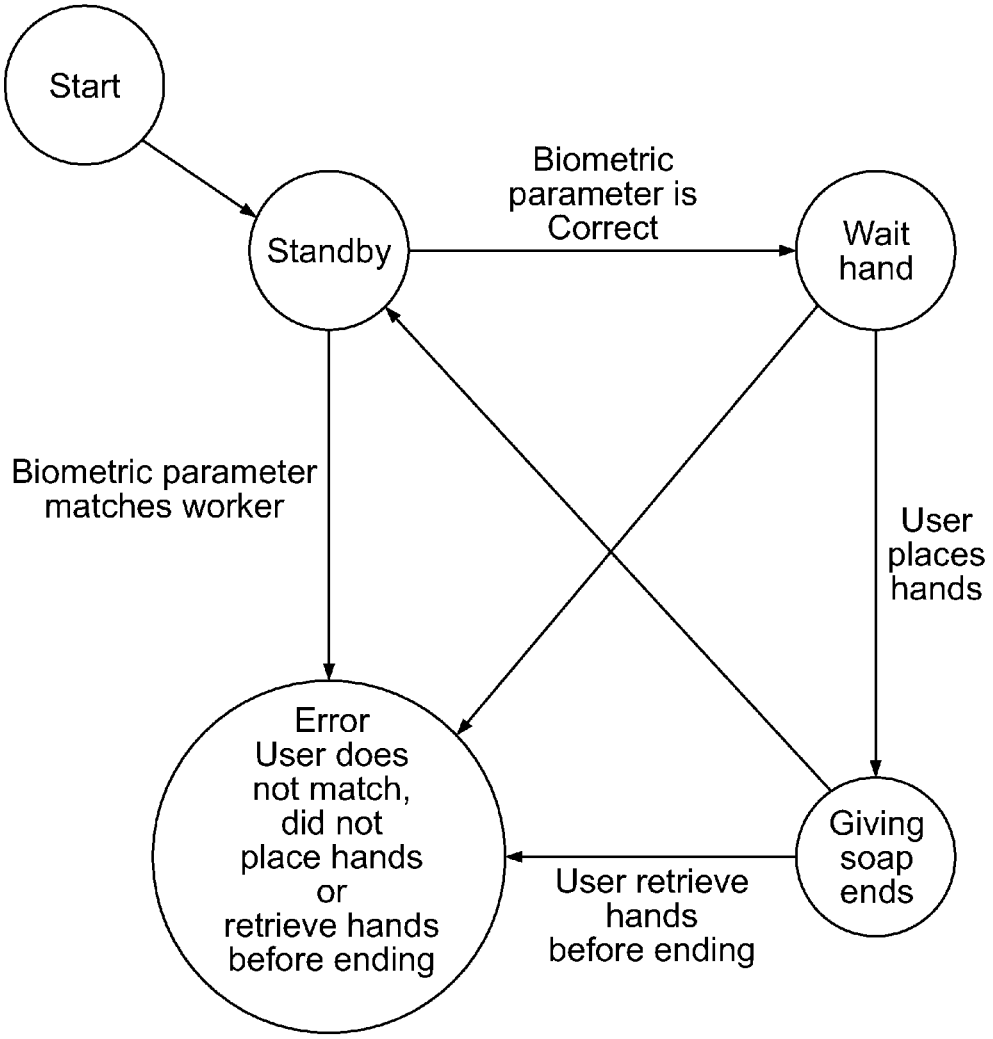
FIG. 6 illustrates a block diagram showing the functioning of the hand wash and sanitation device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a hand wash and sanitation device that controls hygiene of the personnel while performing their work related functions in areas where complete asepsis is required. In addition, the present invention generally provides a hand wash and sanitation device that controls the use of the device by each one of the workers by using biometrics parameters. Furthermore, the present invention generally provides a hand wash and sanitation device that keeps records of the use of the device by each one of the workers during the preset schedule. Finally, the present invention generally provides a hand wash and sanitation device that detects if the personnel had properly sanitized their hands during a preset schedule and then effectively helps in taking the necessary steps to ensure the required sanitization.

The hand wash and sanitation device according to the present invention may be used to control and pursue the washing of hands by emitting a warning signal via SMS to the supervisory personnel, of a violation of the worker's preset hand washing schedule or improper hand washing. The hand wash and sanitation device according to the present invention may be programmed to meet the necessity of each individual company or institution.

FIGS. 1-5 illustrate a hand wash and sanitation device 10 according to an exemplary embodiment of the present invention. The hand wash and sanitation device 10 may include a housing 20 having a biometric scanner 30 connected to the housing 20, a screen 40 placed on the front face of the housing 20, a liquid dispenser 50 placed inside the housing 20 and also operatively connected to the biometric scanner 30, and a computer device 60 including a software program, the computer device 60 may be also operatively connected to the liquid dispenser 50 and to the biometric scanner 30.

The housing 20 may be made of a sturdy material. In some embodiments, the housing 20 may be made of plastic, metal, polymer, or composite material. The size of the housing 20 may depend on the customer's requirements. The housing 20 may be a hollow housing. The housing 20 may enclose all of the components of the hand wash and sanitation device 10.

The screen 40 may be a touch screen. The screen 40 may display the information from the worker using the hand wash and sanitation device 10. The size of the screen 40 may depend on the customer's requirements. The screen 40 may allow the user to manipulate the use of the hand wash and sanitation device 10.

The biometric scanner 30 may be a fingerprint scanner, a voice recognition scanner, a face recognition scanner, an iris scanner, or a palm scanner, or any other technology which may be developed in the future for identity recognition. In some embodiments, the biometric scanner 30 may be a non-contact palm scanner. The power may be supplied to the biometric scanner 30 by a power supply device 70. The power supply device 70 may be a commercially available power supply. In some embodiments, the power supply 70 may be an ATX power supply device, an electrical power supply, or batteries. The biometric scanner 30 may include a very sensitive sensor inside (not shown).

The hand wash and sanitation device 10 may be on standby position and as the worker approaches the hand wash and sanitation device 10 may be activated immediately. A video camera 88 having face recognition feature may be placed inside the hand wash and sanitation device 10. The video camera 88 may be use to identified the worker and also to record the worker's hand washing activity during the time predetermined by the patron. The recorded video may be used in case of legal issues. The video camera 88 may be placed near the screen 40.

The computer device 60 may be operatively connected to the biometric scanner 30. The biometric scanner 30 may send the worker's information to the computer device 60. The computer device 60 may include a software program specially designed to be adaptable to any existing computer program being utilized by the user institution that may allow the identification of the worker by a specific biometric parameter. The software program may allow creating a database including information of all the personnel of the establishment. The information on the database may be encrypted. The database may include, for each worker record, information such as a biometric parameter, a photograph, work schedule, frequency on which the worker washes his/her hands, preset schedule for the worker to wash his/her hands, etc.

Each worker, including the supervisory and managerial personnel, may have a password associated with the biometric parameter to access the hand wash and sanitation device 10. The supervisory and specific managerial personnel may be the only people authorized to provide input about specific workers to the software program. Only such level of authority may be allowed to modify the software program adding or deducting authorized personnel. The term "managerial" may refer to the owner of the establishment. The information of the database may be periodically backed up.

The software program may control for each worker the time needed for a complete personal asepsis. In addition, the software program may allow the computer device 60 to emit a warning signal to the supervisory personnel regarding a violation of each individual worker's preset hand washing schedule. The warning signal may be sent to the supervisory personnel in the form of a phone call, text message, e-mail, or audible alarm. In addition, the computer software program may detect if the personnel has properly sanitized their hands during a preset schedule and then take the necessary steps to ensure the proper sanitization. A second scanner 85 may be placed on the washing area 86 of the housing 20. The second scanner 85 may be used to detect if the hands or fingers of the worker are clean. The second detector may be a commercially available dirt detector. In some embodiment, the second detector 85 may be a commercially available 3M dirt detector. Furthermore, an odor sensor (not shown) may be placed on the washing area 86. The odor sensor (not shown) may be use to determine if the hands are clean. If the odor sensor (not shown) senses the odor of soap means that the hands are clean. If the odor sensor (not shown) senses the odor of ammonia (urine), feces, or sulfides means that the hands are dirty. Then, the computer program will emit an audible or visual signal to indicate that the hands are dirty.

Furthermore, the computer software may detect that a worker has violated his/her established hand washing preset schedule and emit a signal requesting the worker to wash his/her hands properly. The signal may be an audible signal or a digital signal.

The main components of the computer device 60 may be a commercially available hard drive 120, a motherboard 130 including a memory, and a convertor for a video connector 140. Other standard components normally used by a computer device may be included on the computer device 60. These and other parts may be protected by patents of invention which we will certainly respect.

The software program may be manipulated by different modes. The operation mode may be activated by the supervisor and/or manager. The administration mode may allow the access to functions on the software to determine the liquid level sensors, alarms, audio signal devices, computer connections, pre-set schedule washing of the hands of each worker, and/or passwords for each worker.

The computer device 60 may be operatively connected to a door access mechanism to control the entry and/or exit of each worker to the working area, depending on their hand wash status. In addition, the hand wash and sanitation device 10 may limit the access of non-authorized personnel to the restricted area or other areas considered sanitation sensitive. The software program may set a washing time for each worker. If the worker washes his/her hands as stipulated by the washing time, then the hand wash and sanitation device 10 may emit a green light and the worker may have access to the working area. If the worker did not wash his/her hands as stipulated by the washing time, then the hand wash and sanitation device 10 may emit a red light and the worker may be denied access to the working area.

The liquid dispenser 50 may be connected to the biometric scanner 30 by a conduit 80. In addition, the liquid dispenser 50 may be connected to a reservoir 92 containing an antiseptic substance or antiseptic device. The antiseptic substance may be a commercially available cleaning solution, antimicrobial solution, plasma, or anti-bacterial solution. The antiseptic substance may be in liquid, plasma, or gel form, or any other technically accepted disinfecting system.

The reservoir 92 may be made of an anti-corrosion material. In some embodiments, the reservoir 92 may be made of acrylic. The reservoir 92 may be hermetically sealed to ensure the purity of the content. In some embodiments, the reservoir 92 may be a pouch to prevent contamination.

A liquid level sensor (not shown) and visual indicator 90 may be placed on the reservoir 92. The screen 40 may indicate the current level of the antiseptic substance. If the level of the antiseptic substance falls within a predetermined value, the liquid level sensor (not shown) may alert the supervisory personnel that a refill is needed by activating the visual indicator 90.

A dosage pump 100 may be placed at the end of the conduit 80 near the liquid dispenser 50. The dosage pump 100 may be a commercially available dosage pump. The dosage pump 100 may dispense the predetermined amount of antiseptic substance as dictated by the software program for washing the hands and/or elbows and forearm. Each institution may determine the ideal quantity of antiseptic substance.

Once the worker approaches the hand wash and sanitation device 10 and the device 10 is activated, the worker may place the part of his/her body on the biometric scanner 30. The biometric scanner 30 will recognize the worker, display the identity of the worker, and send an output signal to the liquid dispenser 50. The output signal may activate the dosage valve 100. The dosage valve 100 may then dispense a predetermined amount of the antiseptic substance on the hand of the worker. The software program may record the name of the worker, date and time, and the amount of antiseptic substance dispensed to the worker.

In some embodiments, the liquid dispenser 50 may be replaced with a commercially available device used for cleaning hands. In some embodiments, the device used for cleaning hands may be a high frequency emission device, microwaves emission device, or by a plasma device. In some embodiments, the device used for cleaning hands may be a low temperature plasma device. The low temperature plasma device may help clean hands and/or body part in seconds as compared with the antiseptic substances. In addition, the low temperature plasma device may allow to clean areas difficult to reach, such as underneath the nails and feet.

The biometric scanner 50 may be connected to electronic signal devices 110 strategically located on the housing 20. The electronic signal devices 110 may send customized periodic warnings ordering each specific worker to report to the corresponding controls of hygiene.

When the worker receives the warning signal from the hand wash and sanitation device 10, the worker must go to the hand wash and sanitation device 10 and activate the biometric scanner 30 by placing the thumb and/or body part on the biometric scanner 30. The sensor (not shown) inside the biometric scanner 30 may send a codified digital information indicating the hygienic state of the hands/fingers.

In case of detecting dirt or the presence of impurities in general, the sensor (not shown) may send a signal to a relay (not shown), which may close contacts 160, activating the dosage valve 100 dispensing the required amount of antiseptic formulation to wash the hands of the worker. Next, the hand wash and sanitation device 10 may store the information corresponding to the data of the worker and the hour in which cleaning was performed.

In some embodiments, a plurality of screens (not shown) may be operatively connected to the hand wash and sanitation device 10. The screen (not shown) may be placed at strategic positions through the working area, thus, the warning signal emitted by the software program may be seen at the working area, advising the worker to wash his/her hands.

The hand wash and sanitation device 10 may control the schedule of employees, detail of worked hours, and a control of visits to the bathroom. All of these functions are properly recorded in daily, weekly or monthly reports. Every day, each worker may be informed of any violation of the preset schedule.

Table 1 compares the differences between the inventor's prior hand wash and sanitation device and the hand wash and sanitation device 10 (present invention).

The hand wash and sanitation device 10 may be used in restaurants, food processing industry, pharmaceutical industry, grocery stores, laboratories, hospitals, doctor's offices, hotels, industrial, catering, health industry, or surgery rooms.

Comparative Example to Determine the Efficiency of the Hand Wash and Sanitation Device Versus Other Sanitation Devices. Study Carried Out for the Food Industry.

A research was made to determine the efficiency of the hand wash and sanitation device 10 against the traditional systems of sanitation. The objective of the res/*Pearch is to observe the counts of microbial indicators with three methods of hand sanitation application.

All the information was properly recorded in daily, weekly and monthly reports that allow measuring not only the efficient hand wash, but also real work hours by each sector access.

The investigation study observes the importance of direct controlling of concurrency of the handler through an announcement signal of the obligatory hand wash and the importance of the identification and monitoring that the handler exposes, it can identify making the procedure in time for the hand sanitation, making an efficient prevention to reduce the FTD.

Research Objectives

The different systems of wash and sanitation are going to be verified by the announced methods with or without the signal advice. With signal advises alone and with the hand wash and sanitation device 10 signal. The testing was performed by frequency control of attendance from employees through a software procedure with products based on TRICLOSAN 0.3%. It was used for the research the RODAC methodology of analysis determining the group of coli forms bacteria and *Scherichia Coli* with CHROMAGAR ECC media controlling during time work. The procedure of the investigation is, in the normal operation of work, controlled after the electric signal sound for the wash of hands and the pointed hours of control, a printing of the right thumb with a RODAC sheet and the CHROMAGAR ECC microbiological control, and it is incubated according to the methodology that the producer indicates, making the control a recording of the information.

Methodology

It is a defined place of control, the one's choice to observe a homogeneous production in number of process units. Initially the control of hands is made by a RODAC sheet, with CHORMAGAR ECC media, being the control made at 8, 9, 10, 11, 12 and 13 hours. Then they are sent to Tecnofood Laboratorie, where they are incubated according to the methodology and the final control is made, registering the found values.

The staff previously loudly announced the compulsory hand wash and gave a description of problems that bad hygiene brings. The procedure is made during a week. After it is-placed in the previous condition an additional sign indicates each hour, after the printed control is realized, also during a week. Finally the hand wash and sanitation device 10 with signal control of print and management of soft is making the print control. In all cases, it is sent to the Tecnofood Laboratorie for the count and the identification and registration of founded values.

Type of Study General

The experimental study is going to be fulfilled controlling mixed sex groups, according to normal distribution of the population tested. This study is applied in a universe of total population which, at those moments, is working in handling food at the place of work. The selection and size of the sample is from the 100% of the staff, which in average of real samples of analysis unit, was twelve handlers by premise each day.

Observation: As the study was made during a week period, the value is average due to the absence of precise persons of the staff.

Procedure for the Collection of Information

The procedure which was used in the preparation of the RODAC PLACAS, with CHORMAGAR ECC media, through Tecnofood Laboratory, which gives a batch to each consignment, that validates in an internal way the controls realized to guarantee its sterility and viability. Staff from the laboratory in the three cases of announced signal and in the pointed hour will be made through matriculated professionals, the control and the printing of RODAC sheets, according to the description of the MANUAL FAO 14/12 for this method. The sheets are sent to the laboratory in a three hour term where the incubation is made according to the methodology indicated by the manufacturer and it is recorded in tables destined for that end.

Analysis Plan of Results

Following the founded data are described in the PLACAS RODAC control and the CHORMAGAR ECC media, initially the control of generic *Eschirichia Coli* is visualized in hands:

Control without signal

Control with a sound signal

Control with sound "HAND SECURE" (Registered Trademark for the Device according to the present invention) and control action taken Note: The registered values reaching 19 coli forms by sheet of *Escherichia coli* presence are considered not appropriate and are in red Control without Signal (Weekly Average)

| N of Handler | Coliforms | *E Coli* |
|---|---|---|
| 1 | 23 | positive |
| 2 | 0 | negative |
| 3 | 37 | positive |
| 4 | 40 | positive |
| 5 | 0 | negative |
| 6 | 30 | positive |
| 7 | 28 | positive |
| 8 | 0 | negative |
| 9 | 39 | positive |
| 10 | 24 | positive |
| 11 | 0 | negative |
| 12 | 45 | positive |

Control with Signal (Weekly Average)

| N of Handler | Coliforms | *E Coli* |
|---|---|---|
| 1 | 12 | negative |
| 2 | 7 | negative |
| 3 | 30 | positive |
| 4 | 29 | positive |
| 5 | 5 | negative |
| 6 | 9 | negative |
| 7 | 35 | positive |
| 8 | 2 | negative |
| 9 | 33 | positive |
| 10 | 6 | negative |
| 11 | 0 | negative |
| 12 | 39 | positive |

Control with Hand Wash and Sanitation Device 10 (Weekly Average)

| N of Handler | Coliforms | *E Coli* |
|---|---|---|
| 1 | 2 | negative |
| 2 | 0 | negative |
| 3 | 6 | negative |
| 4 | 0 | negative |
| 5 | 3 | negative |
| 6 | 8 | negative |
| 7 | 0 | negative |
| 8 | 0 | negative |
| 9 | 3 | negative |
| 10 | 5 | negative |
| 11 | 0 | negative |
| 12 | 4 | negative |

Graphics Applied to Results

Figure 7:
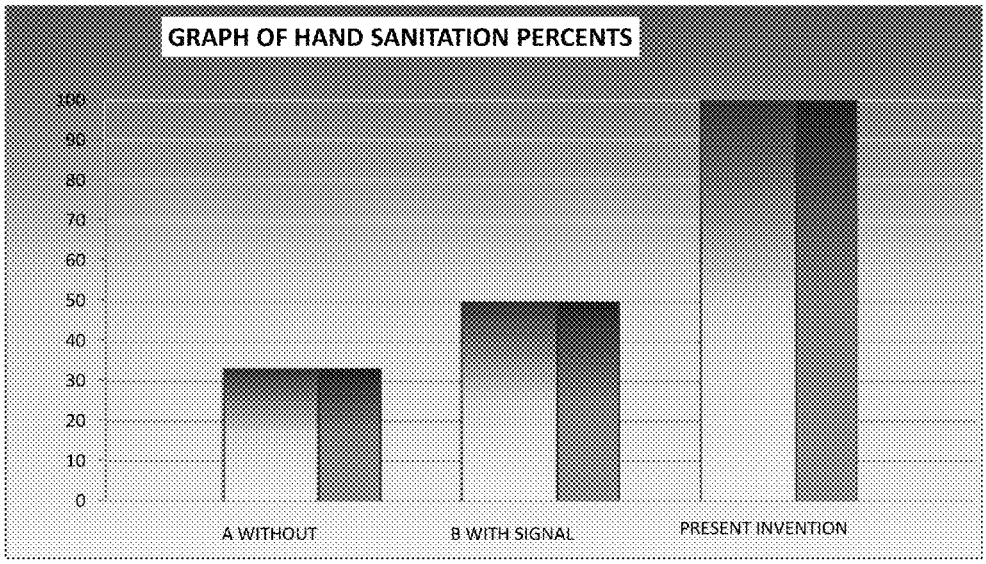
FIG. 7 illustrates the results of different hand wash test.

FIG. 7 shows the average of sanitation of hands with each system, A, without signal, B with signal, and C hand wash and sanitation device 10.

CONCLUSIONS

In the investigation study, it is observed the importance of direct control attendance of the handler before an announcement signal of the compulsory hand wash and the importance of the identification and monitoring that the handler is exposed, being that he/she can be identified in a reliable way, proceed in time and in a proper way the wash of his/her hands making an efficient prevention in decreasing FTD.

All efficient prevention methods are ahead of the problem and the use of new technology is a solution.

It should be understood, of course, that the foregoing relates to exemplary embodiments of the invention and that modifications may be made without departing from the spirit and scope of the invention as set forth in the following claims.

What is claimed is:

1. A hand wash and sanitation device consisting of:

a hollow housing having a front face, a back face, sides, an interior, wherein the housing encloses:

a biometric scanner connected to the housing, the biometric scanner reads a biometric parameter of a user;

a screen located on the housing and connected to the biometric device;

a liquid dispenser operatively connected to the biometric scanner, wherein the liquid dispenser includes a dosage valve that dispenses a predetermined amount of an antiseptic formulation;

a computer device including a software program, the software program controls the operation of the liquid dispenser, includes a preset schedule for each user to wash their hands, detects when a user violates the preset schedule, and emits a warning signal if the user violates the preset schedule;

a second scanner located next to the liquid dispenser, the second scanner chosen from at least one of a dirt scanner or an odor sensor;

an electronic signal device connected to the biometric scanner, the electronic signal device sends an individual customized warning to the user to report to the hand wash and sanitation device when the user violates the preset schedule; and the dosage valve is controlled by the software program;

wherein the computer device is connected to the liquid dispenser and to the biometric dispenser.

2. The hand wash and sanitation device according to claim 1, wherein the software program controls if the user has properly sanitized their hands during the preset schedule.

3. The hand wash and sanitation device according to claim 1, wherein the biometric scanner is a non-contact scanner.

4. The hand wash and sanitation device according to claim 3, wherein the biometric scanner is a non-contact hand palm scanner.

5. The hand wash and sanitation device according to claim 1, wherein the screen is a touch screen.

6. The hand wash and sanitation device according to claim 1, wherein the screen displays personal information of the user based on the information received from the biometric scanner.

7. A hand wash and sanitation device consisting of:

a hollow housing having a front face, a back face, sides, an interior, wherein the housing encloses:

a biometric scanner connected to the housing, the biometric scanner reads a biometric parameter of a user;

a screen located on the housing and connected to the biometric device;

a liquid dispenser operatively connected to the biometric scanner, wherein the liquid dispenser dispenses a predetermined amount of an antiseptic formulation;

a computer device including a software program;

a second scanner located next to the liquid dispenser, the second scanner chosen from at least one of a dirt scanner or an odor sensor;

a video camera located near the screen, the video camera including a face recognition detector;

a door access mechanism connected to a door, wherein the door access mechanism is controlled by the software program;

optionally a low temperature plasma device operatively connected to the biometric scanner; and optionally a plurality of auxiliary screens operatively connected to a computer device, wherein the auxiliary screens are placed through a working area, wherein the auxiliary screens remind the users to wash their hands.

8. The hand wash and sanitation device according to claim 1, wherein the software program further controls a working schedule of the user, the user's visits to a bathroom, and a user's access and non-access to a working area.

9. The hand wash and sanitation device according to claim 1, wherein the biometric scanner is a fingerprint, iris, or voice recognition biometric scanner.

10. The hand wash and sanitation device according to claim 1, wherein the dosage valve is a hydraulic electro valve.

11. A hand wash and sanitation device consisting of:

a hollow housing having a front face, a back face, sides, an interior, wherein the housing encloses:

a biometric scanner connected to the housing, the biometric scanner reads a biometric parameter of a user;

a screen located on the housing and connected to the biometric device;

a liquid dispenser operatively connected to the biometric scanner, wherein the liquid dispenser dispenses a predetermined amount of an antiseptic formulation;

a computer device including a software program;

a second scanner located next to the liquid dispenser, the second scanner chosen from at least one of a dirt scanner or an odor sensor; and a video camera located near the screen, the video camera including a face recognition detector.

12. The hand wash and sanitation device according to claim 11, wherein the user accesses the dispenser device by using a password.

* * * * *